United States Patent [19]

Gaffigan

[11] Patent Number: 4,833,449

[45] Date of Patent: May 23, 1989

[54] HOME SECURITY SYSTEM

[76] Inventor: Robert J. Gaffigan, 22524 Millenbach, St. Clair Shores, Mich. 48081

[21] Appl. No.: 214,949

[22] Filed: Jul. 5, 1988

[51] Int. Cl.[4] ..... G08B 26/00

[52] U.S. Cl. ..... 340/505; 340/539; 340/531; 340/522

[58] Field of Search ..... 340/505, 506, 539, 531, 340/514, 825.54, 825.69, 515, 825.72, 696, 522; 455/53, 95, 100

[56] References Cited

U.S. PATENT DOCUMENTS 3,833,895 9/1974 Fecteau ..... 340/505

4,422,068 12/1983 Helft et al. ..... 340/506

*Primary Examiner*—Donnie L. Crosland

*Attorney, Agent, or Firm*—Gifford, Groh, Sheridan, Sprinkle and Dolgorukov

[57] ABSTRACT

A security system for a home having one or more security zones. A main station is associated with the home and, when initialized, constantly monitors the state of remote intruder sensors throughout the home. Upon receipt of a signal from one of the intruder sensors, the main station activates an alarm and also stores an alarm value representative of the zone in which the intruder sensor was activated. A remote station includes a radio transmitter which, upon activation by a person about to enter the home, generates an interrogation signal to the main station. Upon receipt of the interrogation signal by the main station, the main station checks for the presence of the alarm value. If the alarm value has been set, indicative that an intruder sensor has been activated, the main station flashes exterior lights on the home thereby warning the person of the possible presence of an intruder within the home.

10 Claims, 3 Drawing Sheets

HOME SECURITY SYSTEM

BACKGROUND OF THE INVENTION

I. Field of the Invention

The present invention relates to home security systems.

II. Description of the Prior Art

There are many previously known home security systems which are designed to secure the home against intruders. These previously known systems typically comprise a plurality of intruder sensors which are positioned throughout the home. These intruder sensors include motion detectors, vibration detectors and the like. Furthermore, the home is typically divided into two or more security zones, such as the garage, the basement and the main living quarters.

These previous home security systems include a main control unit which constantly monitors all of the intruder sensors in the system. Upon the receipt of a signal from one of the intruder sensors, the main control unit sounds sirens, lights lights, sends signal to a remote location, and the like in an attempt to alert police or to alert the neighbors to call the police or otherwise apprehend the intruder. Typically, the alarm is activated for a preset period of time, such as ten minutes, after which the system resets.

Some primary disadvantages of these previously known home security systems is that no warning is given to the owner of a possible intruder presence just before entering the house. Also, these systems are prone to false alarms. Consequently, after a few false alarms, neighbors tend to ignore subsequent alarms even though such alarms are not false alarms.

Consequently, with these previously known systems the possibility arises that the intruder can enter the home and deactivate the alarm sirens and lights while the neighbors treat the initial activation of the alarms as a false alarm. This is particularly dangerous for the homeowner when he or she returns to the home since the intruder may still be present within the home.

SUMMARY OF THE PRESENT INVENTION

The present invention provides a home security system which overcomes all of the above mentioned disadvantages of the previously known systems.

In brief, the present invention comprises a main station having a central control unit which monitors a plurality of intruder sensors positioned in one or more security zones throughout the home. The intruder sensors are preferably connected to the central control unit by a radio link although they may be alternatively hardwired to the central control unit.

Upon receipt of a signal from one of the intruder sensors by the central control unit, the central control unit sounds alarms, lights lights, and may provide other types of alarm signals for a preset time period in the conventional fashion. In addition, however, the central control unit stores an alarm value indicative not only that an alarm has been sounded, but also indicative of the zone in which the alarm occurred.

The system also includes a remote station having a radio transmitter which, upon activation, generates an interrogation signal. This interrogation signal is received by a radio receiver in the central control unit which then checks for the presence of the stored alarm value and thus checks to determine whether an intruder sensor has been activated since the last system initialization. In the event that an intruder sensor has been activated since the last system initialization, the central control unit flashes exterior lights on the home to warn the homeowner of the possible presence of an intruder in the home. Preferably the central control unit flashes the exterior light a number of times corresponding to the zone in which the intruder sensor was last activated.

The homeowner may then call the police or take whatever other action the homeowner deems appropriate.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
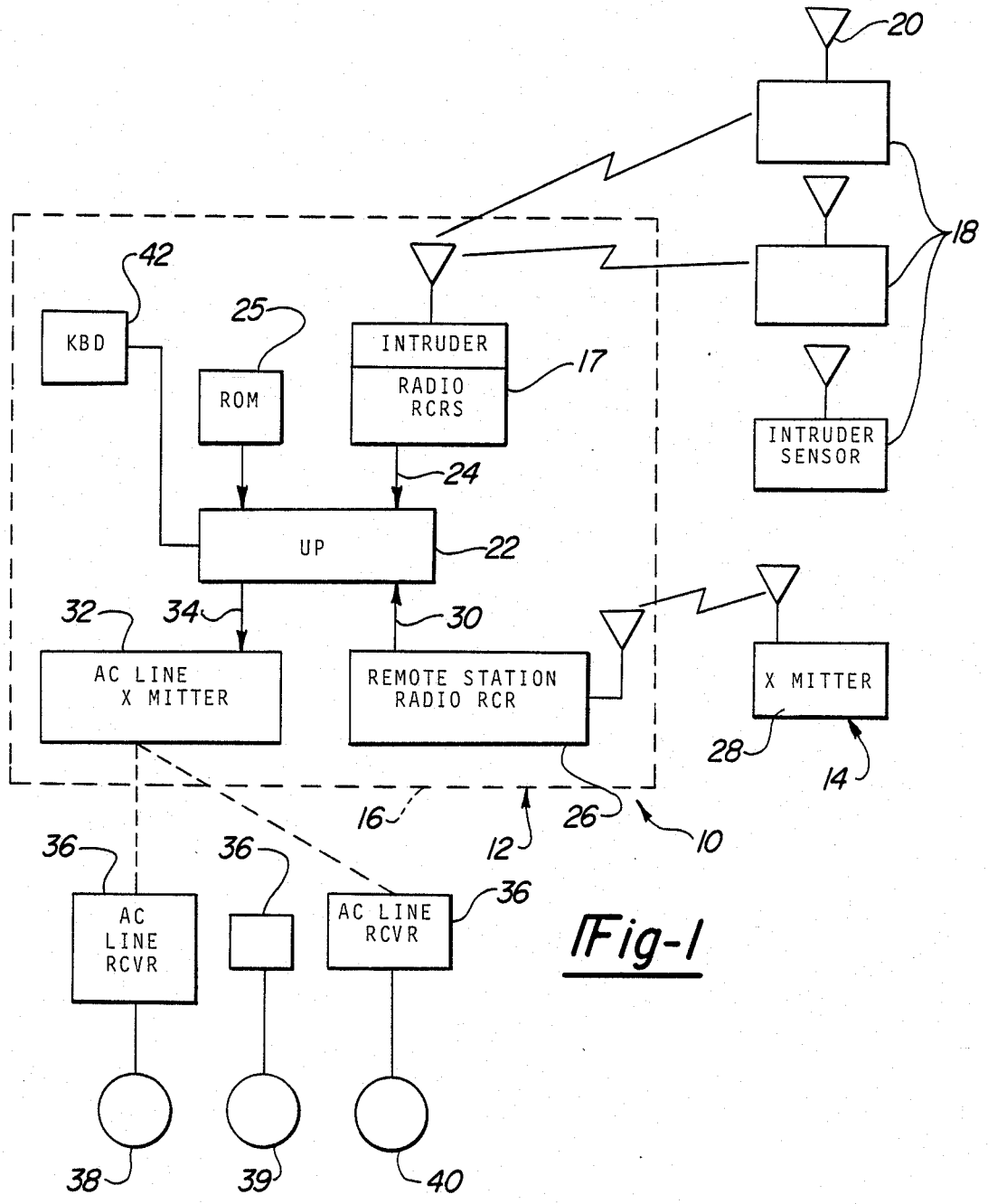
FIG. 1 is a block diagrammatic view illustrating a preferred embodiment of the present invention.

With reference first to FIG. 1, a preferred embodiment of the home security system 10 of the present invention is there shown and comprises a main station 12 and a remote station 14. As will be shortly described in greater detail, the main station 12 is physically associated with the home while the remote station 14 is portable and is carried by the homeowner or kept in his or her car.

The main station 12 comprises a central control unit 16 and a plurality of intruder sensors 18. These intruder sensors 18 are positioned around the home to be protected and comprise, for example, motion detectors, vibration detectors, heat detectors, closure detectors and the like. Each intruder sensor 18 is conventional in construction and, when activated, generates a radio signal on its individual antenna 20.

Preferably, the home is divided into two or more security zones. For example, the garage forms one zone, the basement a second zone and the main living quarters a third zone. Furthermore, the intruder sensors 18 for a particular zone, when activated, generates a radio signal which is unique to that particular zone.

The central control unit 16 contains a microprocessor 22 which continually executes a program contained in read only memory 25. The central control unit 16 includes a radio receiver 17 which receives the radio signals from the intruder sensor 18, when activated, and provides an output signal on line 24 to the microprocessor 22 indicative of the activation of the intruder sensor 18. The procedure executed by the microprocessor 22 upon receipt of a radio signal from one of the intruder sensors 18 will be subsequently described.

Still referring to FIG. 1, the remote station 14 comprises a radio transmitter 28, such as a garage door transmitter, which, when activated, transmits an interrogation pulse to the main station 12. This interrogation pulse is received by a radio receiver 26 at the central control unit 16 which sends an interrogation signal on line 30 to the microprocessor 22 each time an interrogation pulse is received from the remote station 14.

An AC line transmitter 32 is contained within the central control unit 16 and is controlled by output signals on line 34 from the microprocessor 22. The AC line transmitter 32 transmits signals on the electrical wiring for the home to AC line receivers 36 which control the illumination of exteriorly visible lights 38, sirens 39 and/or other signaling means 40.

A key pad 42 is mounted on the central control unit 16 which enables the user to manually input different modes of operation of the system 10. The key pad 42 is also used by the owner to reset or disarm the system 10 whenever the owner enters the home.

Figure 2A:
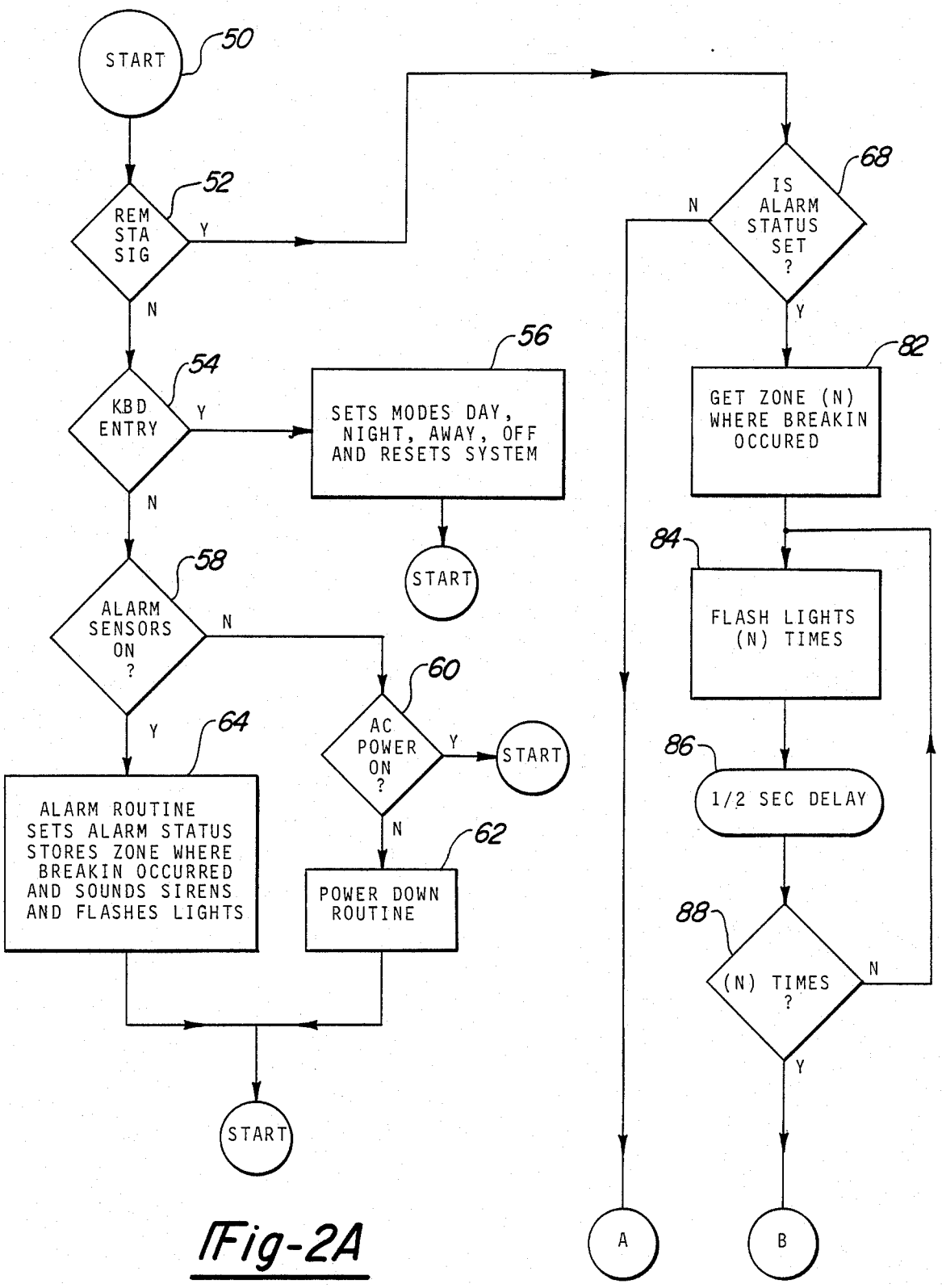
FIGS. 2A and 2B are flow charts illustrating the operation of the preferred embodiment of the present invention.
Figure 2B:
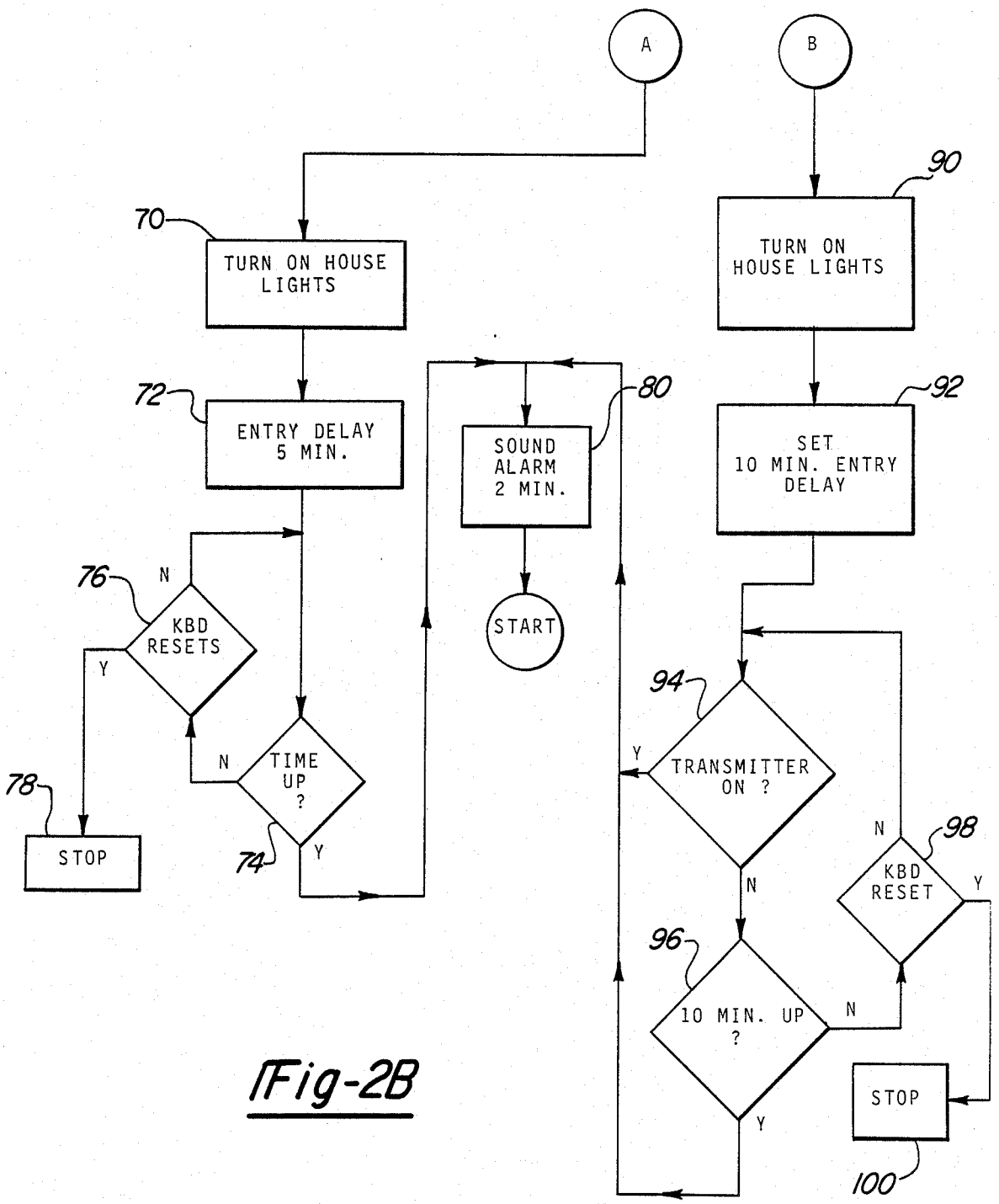

With reference now to FIG. 2, the operation of the present invention will now be described. The system 10, when initialized, begins at step 50 which immediately branches to step 52. At step 52 the microprocessor 22 first checks to determine if a radio signal has been received from the remote station 14 and, if not, branches to step 54.

At step 54 the microprocessor 22 scans the key pad 42 to determine if a key pad entry has been made. The key pad 42 is used to set the system 10 to different operating modes as well as to reset the system 10 after an authorized entry by the owner. In the event of a key pad entry step 54 branches to step 56 where the system is reset and then branches to step 50. Step 56 also presets an alarm value to zero, indicative of system initialization, for a reason to be shortly described.

Assuming no key pad entry, step 54 branches to step 58 where the microprocessor 22 determines whether an intruder sensor 18 has been activated by reading the input from line 24 from the radio receiver 17. If no intruder sensor 18 has been activated step 58 branches to step 60 to test for a power failure and, if none, returns to step 50 where the above process is repeated. If a power failure has occurred, step 62 executes a power failure routine before returning to step 50 and, for this purpose, the system 10 includes a battery backup.

Conversely, in the event that an intruder sensor 18 has been activated, indicative of an unauthorized entry into the home, step 58 branches to step 64. At step 64 the microprocessor 22 activates the lights 38, siren 39 and other signaling means 40 for a preset period of time, such as ten minutes, in an effort to frighten away the intruder. Additionally, step 64 stores a number in the alarm value (which was originally set to zero in step 56) indicative not only that an intruder sensor 18 has been activated, but also the zone in which the activation occurred. For example, step 64 stores a "1" in the alarm value if the activated intruder sensor 18 is in zone one, a "2" if in zone two and so on. Step 64 then returns to step 50 where the above process is reiterated.

When the homeowner returns to the home and prior to entry into the home, the owner activates the transmitter 28 at the remote station 14 and transmits an interrogation pulse to the central control unit 16 which is received by the receiver 26. Upon receipt of this interrogation pulse, step 52 branches to step 68 which compares the alarm value to zero. If zero, indicative that an intruder sensor 18 has not been activated since the last system reset, step 68 branches to step 70 which turns on, and leaves on, the home lights through AC line transmitters 36.

Step 70 then branches to step 72 where a time delay, e.g. five minutes, is set to allow the owner to enter a reset code on the key pad 42. Step 72 branches to step 74 which determines if the time delay has expired and, if not, branches to step 76 to read the reset code from the key pad 42. If the proper reset code is entered, step 76 branches to step 78 which deactivates the system 10. Conversely, if the proper reset code is not entered within the preset time delay, step 74 branches to step 80 and activates the lights 38, siren 39 and other signaling means 40 for a preset time period and then return to step 50.

Assuming now that the alarm value is non-zero, indicative that an intruder sensor 18 has been activated since system initialization, step 68 branches to step 82 which determines the zone in which the intruder sensor 18 was activated and then branches to step 84. At step 84 the microprocessor 22 generates signals through the AC line transmitter 36 to flash the exteriorly visible light 38 a number of times corresponding to the zone in which the intruder sensor 18 was activated. For example, if zone 2 is the zone in which the intruder sensor 18 was activated, step 84 flashes the light 38 two times. Steps 86 and 88 repeat this flashing at timed intervals a preset number N times and is visible to the owner. At that time the owner can call the police, enter the home or take any other action he or she deems appropriate.

After steps 84, 86 and 88 flash the lights, step 88 branches to step 90 which turns on the home lights. Step 90 then branches to step 92 which sets an entry delay of ten minutes and then branches to step 84 which determines if a subsequent interrogation pulse is received from the remote station 12. If an interrogation pulse is received, step 94 immediately branches to step 80 and sound the alarm as previously described. Otherwise, step 94 branches to step 96 which determines if the entry delay has expired and, if so, also branches to step 80. If the entry delay has not expired, step 96 branches to step 98 to read the key pad 42 for the reset code and, if entered, branches to step 100 and deactivates the system 10. If the reset code has not been entered, step 98 branches back to step 94 until either (1) the entry delay has expired or (2) the reset code has been entered on the key pad 42.

From the foregoing, it can be seen that the present invention provides a simple, but effective, home security system which enables the homeowner to determine if the intruder alarm has been activated while he or she was away from the home and before entering the home. This warns the homeowner of the possibility of an intruder being present in the home.

It can also be seen from the foregoing that the present invention achieves many advantages over the prior art. One such advantage is that the system can be interrogated remotely and without the homeowner leaving his or her car.

A further advantage is that the present invention is wireless and can be installed without physically changing the home. Thus, with the present system it is unnecessary to drill holes in entrance doors, add lights or the like.

A still further advantage is that the present system is failsafe since, in the event of a system failure or in the event of tampering, the lights will not flash after interrogation.

It will be understood, of course, that the microprocessor can be programmed for different modes of operation in which the system responds to intruder sensors in only certain zones of the home and also responds in different fashions. For example, during nighttime, it may be desirable to only activate the alarms if an intruder sensor in the garage or basement is activated. Similarly, during the daytime it may be desirable to deactivate the siren 39 and lights altogether and instead activate only a buzzer at the central control unit.

It will also be understood that, although radiowaves are preferred for system interrogation, other means, such as sound, infrared or the like can be used. Similarly, enhancements to the system, such as a transponder-responder system between the main and remote station, are possible.

Having described my invention, many modifications thereto will become apparent to those skilled in the art to which it pertains without deviation from the spirit of the invention as defined by the scope of the appended claims.

I claim:

1. A security system for a building having at least one security zone comprising:

a portable remote station, a main station associated with said building, said remote station comprising a transmitter which, upon actuation, transmits an interrogation radio signal, said main station comprising means for detecting the occurrence of a predetermined event within said zone and for storing a preset value representative thereof, a receiver for receiving said interrogation signal from said remote station radio transmitter and for generating an output signal representative thereof, means responsive to said output signal and the presence of said stored preset value for generating a warning signal detectable at a location adjacent said remote station.

2. The invention as defined in claim 1 wherein said transmitter is a radio transmitter and said receiver is a radio receiver.

3. The invention as defined in claim 1 wherein said building includes at least one light and wherein said warning signal generating means comprises means for flashing said at least one light.

4. The invention as defined in claim 3 wherein said building comprises two or more security zones and wherein said warning signal generating means comprises means for flashing said at least one light a number of times corresponding to a number assigned to the zone in which said predetermined event last occurred.

5. The invention as defined in claim 3 wherein said main station comprises means for constantly illuminating said at least one light upon receipt of said output signal and the absence of said stored preset value.

6. The invention as defined in claim 3 wherein said warning signal generating means further comprises a siren and means for activating said siren.

7. The invention as defined in claim 1 wherein said building comprises two or more security zones and further comprising means for detecting the occurrance of said predetermined event only within user selected zone(s) and for storing said preset value representative thereof.

8. The invention as defined in claim 2 wherein said radio transmitter is a garage door transmitter.

9. The invention as defined in claim 3 wherein said at least one light is an exterior light.

10. The invention as defined in claim 1 wherein said main station comprises a microprocessor.

* * * * *